US009883727B2

(12) United States Patent
Chandler

(10) Patent No.: US 9,883,727 B2
(45) Date of Patent: Feb. 6, 2018

(54) PATTERN ASSEMBLY

(71) Applicant: Ricquon D. Chandler, Las Vegas, NV (US)

(72) Inventor: Ricquon D. Chandler, Las Vegas, NV (US)

( * ) Notice: Subject to any disclaimer, the term of this patent is extended or adjusted under 35 U.S.C. 154(b) by 88 days.

(21) Appl. No.: 14/961,633

(22) Filed: Dec. 7, 2015

(65) Prior Publication Data

US 2016/0166040 A1 Jun. 16, 2016

Related U.S. Application Data

(60) Provisional application No. 62/124,131, filed on Dec. 10, 2014.

(51) Int. Cl.
*A45D 27/42* (2006.01)
*A45D 27/00* (2006.01)

(52) U.S. Cl.
CPC ..... *A45D 27/42* (2013.01); *A45D 27/00* (2013.01)

(58) Field of Classification Search
CPC ..... A45D 27/42; A45D 27/00
See application file for complete search history.

(56) References Cited

U.S. PATENT DOCUMENTS 5,402,697 A * 4/1995 Brooks ..... B26B 19/40 30/34.2
8,967,156 B1 * 3/2015 Skidmore ..... A45D 19/0008 132/112
D736,461 S * 8/2015 DoSouto ..... D28/7
2003/0116172 A1 * 6/2003 Bertucci ..... A45D 24/36 132/214
2003/0182801 A1 * 10/2003 Quals ..... B26B 21/00 30/32
2009/0205671 A1 * 8/2009 Saito ..... A45D 24/36 132/213
2009/0223530 A1 * 9/2009 Chapman ..... A45D 27/42 132/200
2013/0213429 A1 * 8/2013 Allen ..... A45D 27/42 132/214
2017/0035178 A1 * 2/2017 Alvarez ..... A45D 27/42

* cited by examiner

*Primary Examiner* — Daniel J Colilla

(57) ABSTRACT

A pattern assembly helps control the removal of hair by joining a template of a predetermined hair pattern directly on the body, such as the face, in conjunction with the application of a depilatory composition. At least one middle template, at least one right template, and at least one left template join correlating middle, right, and left regions of a body, such that the depilatory composition may be applied on the body, generally around the edges, and proximal to the templates. The templates includes a mount surface that engages the body, and an outer surface that is visible. The edges of the templates are tapered so as to inhibit seeping of the depilatory under the template. A handle portion enables holding and manipulation of the templates. An alignment portion enables measured positioning of the templates. The templates are flexible to conform to the various angles of the face.

15 Claims, 6 Drawing Sheets

PATTERN ASSEMBLY

CROSS-REFERENCE TO RELATED APPLICATIONS

The present Utility patent application claims priority benefit of the [U.S. provisional application for patent Ser. No. 62/124,131 filed on 2014 Dec. 10 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

An embodiment of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to a pattern assembly for controlled hair removal. More particularly, the invention relates to a pattern assembly that helps control the removal of hair by joining a template of a predetermined hair pattern directly on the body in conjunction with the application of a depilatory composition; through the use of at least one middle template, at least one right template, and at least one left template that join correlating middle, right, and left regions of a body, such that a depilatory composition applied on the body and outside the periphery of the templates results in a hair pattern that substantially matches the templates.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that trimming, cutting, and shaving facial hair is considered effective for maintaining a well-groomed and attractive beard for self-confidence and comfort. In many instances, it can be very difficult to trim a beard or moustache, especially the symmetry of such beard.

It is known that depilatory compositions are often used to remove unwanted hair by chemical activity. Such compositions may comprise reducing agents to degrade keratin in the hair and thus weaken the hair strands. The depilatory compositions may take the form of creams, lotions and the like which may be applied to the unwanted hair in a variety of ways, such as with a spatula.

Typically, sensitive skin requires the use of the depilatory composition to remove unwanted hair on the face. Due to the viscous nature of depilatory compositions, achieving a symmetrical or precise hair pattern may be difficult. This is especially true when requiring the more precision hair patterns, such as a goatee, a thin moustache, a traditional thicker moustache, and a pointed beard.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a pattern for a traditional moustache, FIG. 1B is a pattern for a thin moustache, and FIG. 1C is a pattern for a goatee, in accordance with an embodiment of the present invention;

FIG. 2A is a pattern for a small sideburn, FIG. 2B is a pattern for a large sideburn, and FIG. 2C is a pattern for a two-piece full beard, and FIG. 2D is a pattern for a two-piece thin beard, in accordance with an embodiment of the present invention;

FIG. 3A is a pattern for a two-piece full beard, and FIG. 3B is a close up view of an exemplary handle portion, in accordance with an embodiment of the present invention;

FIG. 7A is a middle template having a pattern for a goatee covering the middle region of the face, FIG. 7B is an exemplary depilatory composition applied around the middle template, and FIG. 7C is a hair pattern of a goatee after the middle template and the depilatory composition have been removed, in accordance with an embodiment of the present invention.

Figure 1A:
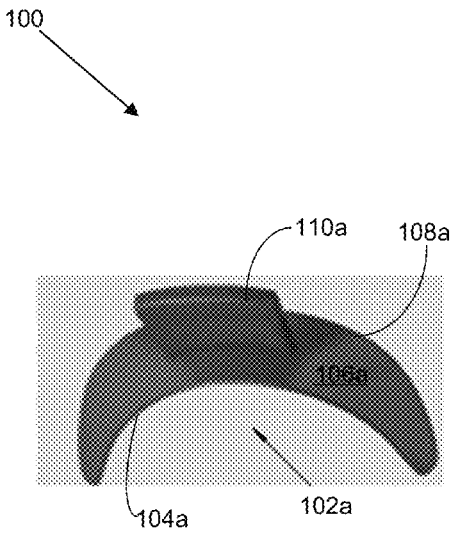
FIGS. 1A, 1B, and 1C illustrate perspective views of an exemplary pattern assembly, and specifically an exemplary middle template, where

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight data aperture of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. §112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight data aperture of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of" and "consisting essentially of" where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings. There are various types of shaving and depilatory templates that enable facilitated patterning of hair on the face that may be provided by preferred embodiments of the present invention. In one embodiment, a pattern assembly helps control the removal of hair by joining a template of a predetermined hair pattern directly on the body in conjunction with the application of a depilatory composition configured to remove hair. In one embodiment, the hair may be generally removed from around the edges and proximity of the pattern assembly; thereby forming the desired hair pattern.

Those skilled in the art will recognize that the pattern assembly is effective for helping users achieve precise borders on beards and moustaches that may ordinarily be difficult to achieve; and especially effective for users of depilatory compositions that desire a precise hair pattern on the face.

In some embodiments, the pattern assembly may include at least one middle template, at least one right template, and at least one left template that join correlating middle, right, and left regions of a body. A depilatory composition may be applied on the body, generally around the periphery and proximal to the templates. The subsequent hair removal in the applied regions of the body results in a hair pattern that substantially matches the templates.

For example, without limitation, a goatee on the face may be patterned by fastening the at least one middle template to a region under the lips and chin, and then applying the depilatory composition to the face, around the middle template and any other region of the face where hair removal is required. After the depilatory composition removes the hair around the middle template, the middle template is removed and the goatee hair pattern forms.

In some embodiments of the present invention, the pattern assembly may include any number of templates that can cover any region of the body. In one embodiment, the pattern assembly may include at least one middle template that covers a middle region of the face or body part; at least one right template that may cover a right region of the face or body part; and at least one left template that may cover a left region of the face or body part.

In some embodiments, the at least one middle template may include a middle mount surface that engages the body, and a middle outer surface that is visible while the middle template is operational. The middle template may be contoured to substantially match a middle region of the body, such as the face. The middle mount surface and the middle outer surface are shaped to form a desired hair pattern, such as a goatee. The middle template further comprises at least one middle edge that is tapered so as to inhibit passage of a depilatory composition to the portion of the body covered by the middle template.

In some embodiments, the middle template may further include a middle handle portion to enable holding the middle template at a desired orientation on the body during removal of the hair. In yet another embodiment, the middle outer surface of the middle template comprises at least one middle alignment portion to help align the middle template and indicate the intended region of the body to be covered by the middle template.

In some embodiments, the at least one right template may include a right mount surface that engages the body, and a right outer surface that is visible while the right template is operational. The right template may be contoured to substantially match a right region of the body, such as the right side of the face. The right mount surface and the right outer surface are shaped to form a desired hair pattern, such as a portion of a beard or moustache. The right template further comprises at least one right edge that is tapered, so as to inhibit passage of a depilatory composition to the portion of the body covered by the right template.

In some embodiment, the right template may further include a right handle portion to enable holding the right template at a desired orientation on the body during removal of the hair. In yet another embodiment, the right outer surface of the right template comprises at least one right alignment portion to help align the right template and indicate the intended region of the body to be covered by the right template.

In some embodiments, the at least one left template may include a left mount surface that engages the body, and a left outer surface that is visible while the left template is operational. The left template may be contoured to substantially match a left region of the body, such as the left side of the face. The left mount surface and the left outer surface are shaped to form a desired hair pattern, such as a portion of a beard or moustache. The left template further comprises at least one left edge that is tapered, so as to inhibit passage of a depilatory composition to the portion of the body covered by the left template.

In some embodiments, the left template may further include a left handle portion to enable holding the left template at a desired orientation on the body during removal of the hair. In yet another embodiment, the left outer surface of the left template comprises at least one left alignment portion to help align the left template and indicate the intended region of the body to be covered by the left template.

Figure 1B:
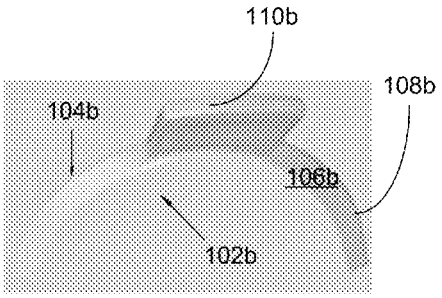
Figure 1C:
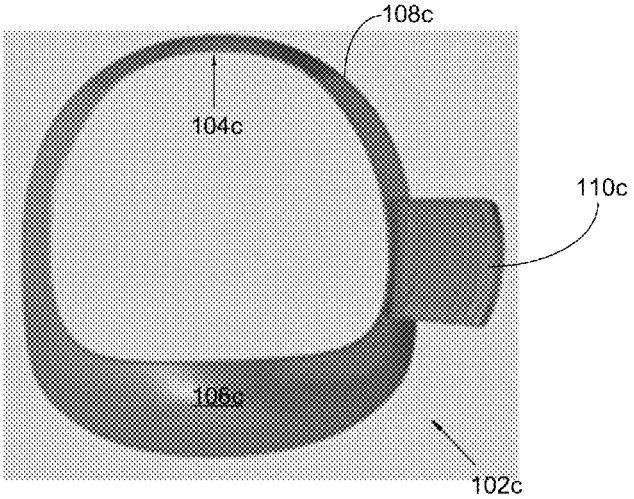

FIGS. 1A, 1B, and 1C illustrate perspective views of an exemplary pattern assembly, and specifically an exemplary middle template, where FIG. 1A is a pattern for a traditional moustache, FIG. 1B is a pattern for a thin moustache, and FIG. 1C is a pattern for a goatee, in accordance with an embodiment of the present invention. In one aspect, a pattern assembly 100 helps control the removal of hair by joining a template of a predetermined hair pattern directly on the body in conjunction with the application of a depilatory composition configured to remove hair. In one embodiment, the hair may be generally removed from around the edges and proximity of the pattern assembly; thereby forming the desired hair pattern.

Those skilled in the art will recognize that the pattern assembly is effective for helping users achieve precise borders on beards and moustaches that may ordinarily be difficult to achieve; and especially effective for users of depilatory compositions that desire a precise hair pattern on the face. Though the pattern assembly is used with a depilatory composition, in other embodiments, the pattern assembly may be used with other hair removal tools and functions, including, without limitation, waxing, Brazilian wax, shaving, and laser hair removal.

In some embodiments, the pattern assembly may include at least one middle template 102*a-c*, at least one right template, and at least one left template that join correlating middle, right, and left regions of a body, such as a face. A depilatory composition may be applied on the body, generally around the periphery and proximal to the templates. The subsequent hair removal in the applied regions of the body results in a hair pattern that substantially matches the templates.

For example, without limitation, a beard comprised of a left and right template covers the region of the face under the chin. The depilatory composition is then applied around the left and right templates to form a hair pattern of a pointed beard. In another exemplary use of the pattern assembly, a goatee on the face may be patterned by fastening the at least one middle template to a region under the lips and chin, and then applying the depilatory composition to the face, around the middle template and any other region of the face where hair removal is required.

Thus, the pattern assembly help users produce precise and symmetrical facial hair appearance while using chemical depilatory products that ordinarily make such precision very difficult to achieve. The pattern assembly may be fabricated in several facial hair styles from a pliable material with contours in their shape. This ensures the middle, right, and left templates, when pressed firmly against the face, lay flat and match the natural shape and slopes of the user's face.

This disposition of the templates helps prevent chemical depilatory from seeping behind the mount surface of the templates. Further, the edges of the templates are tapered to angular points. This accommodates gravitational flow of chemical depilatories and ensures the chemical depilatories flow over top of the template and not behind the template. By preventing the chemical depilatory composition from getting behind the templates, the pattern assembly ensures crisp, sharp and even edges to the facial hair that is covered.

In some embodiments of the present invention, the pattern assembly may include any number of templates that can cover any region of the body. In one embodiment, the pattern assembly includes at least one middle template that may cover a median region of the face or body part; at least one right template that may cover a right region of the face or body part; and at least one left template that may cover a left region of the face or body part.

In some embodiments, the templates may be flexible, so as to conform to the various angles of the face. The templates may be fabricated from a flexible material, including, without limitation, polyvinyl chloride, plasticized polyvinyl chloride, low-density polyethylene, and paperboard with a wax or other coating. However, in other embodiments, the templates may be fabricated from an even more resilient material, such as a soft clay, that enables size and shape adjustments to achieve greater hair pattern design flexibility, making the embodiment extremely flexible but not flimsy.

In some embodiments, the at least one middle template may include a middle mount surface 104*a-c* that engages the body. The middle mount surface may include an adhesive or shape that induces suction to help retain the middle template on the middle region of the body. Though in other embodiments, the middle mount surface may not have any adhesion enhancers, and rely on a middle handle portion to remain engaged to the middle region of the body. The middle template may further include a middle outer surface 106*a-c* that is visible while the middle template is operational. The visible nature of the middle outer surface enables at least one middle alignment portion to display therefrom.

In some embodiments, the middle template may be contoured to substantially match a middle region of the body, such as the face. The middle mount surface and the middle outer surface are shaped to form a desired hair pattern, such as a goatee, a thin moustache, and a thicker traditional moustache. The middle template further comprises at least one middle edge 108*a-c* that is tapered so as to inhibit passage of a depilatory composition to the portion of the body covered by the middle template.

In some embodiments, the middle template may further include a middle handle portion 110*a-c* to enable holding the middle template at a desired orientation on the body during removal of the hair. In yet another embodiment, the middle outer surface of the middle template comprises at least one middle alignment portion to help align the middle template and indicate the intended region of the body to be covered by the middle template. The right alignment portion may include spaced apart markings and a "Left" or "Right" designation to help in proper orienting of the template.

Figure 2A:
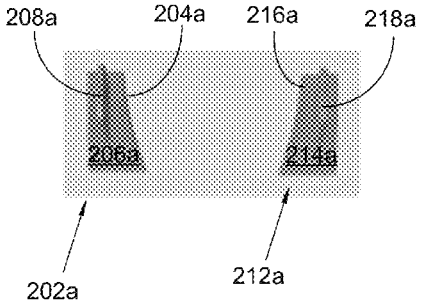
FIGS. 2A, 2B, 2C, and 2D illustrate perspective views of an exemplary pattern assembly, and specifically exemplary right and left templates, where
Figure 2B:
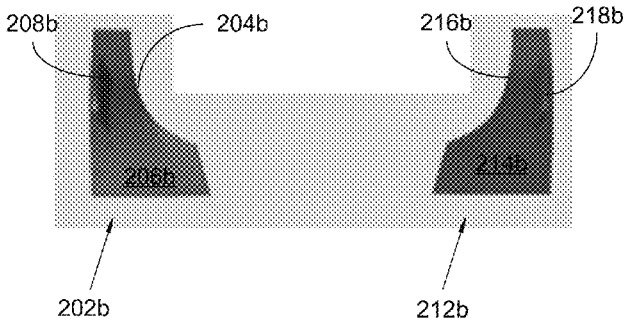
Figure 2C:
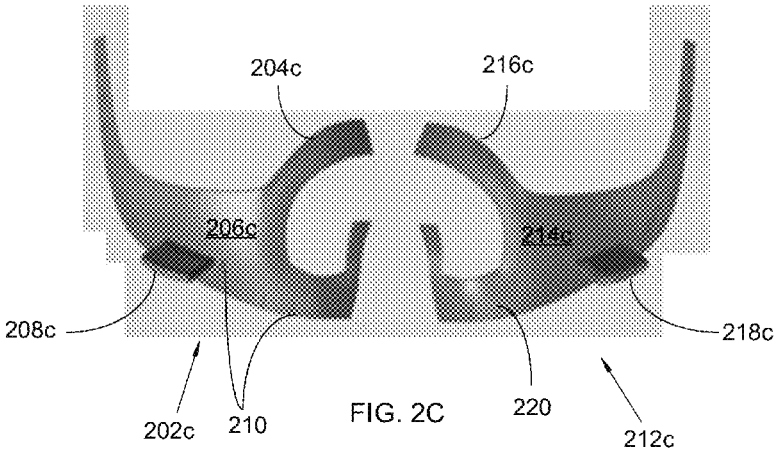
Figure 2D:
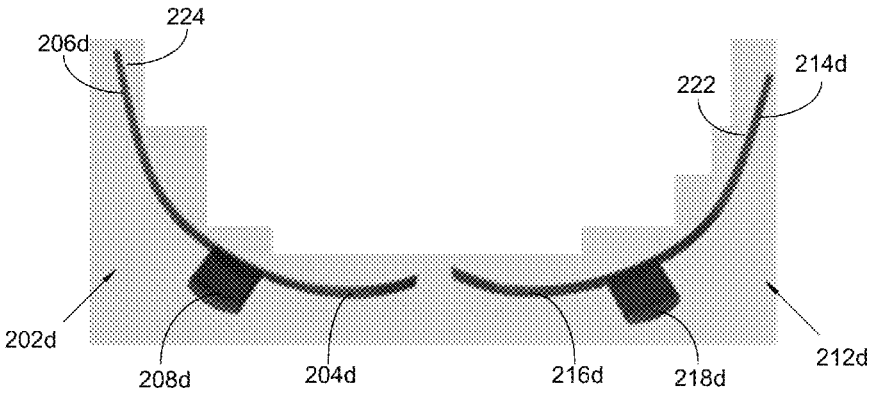

FIGS. 2A, 2B, 2C, and 2D illustrate perspective views of an exemplary pattern assembly, and specifically exemplary right and left templates, where FIG. 2A is a pattern for a small sideburn, FIG. 2B is a pattern for a large sideburn, and FIG. 2C is a pattern for a two-piece full beard, and FIG. 2D is a pattern for a two-piece thin beard. In one aspect, the pattern assembly further utilizes a right template 202*a-d* to form hair patterns on the right region of the body, and a left template 212*a-d* to form hair patterns on the left region of the body. The right template comprises a right mount surface and a right outer surface. Both surfaces are shaped to form a desired hair pattern, such as a portion of a beard, a sideburn, a portion of a moustache, beards, such as Chin curtain, the Winfield, Balbo, and Klingon. Additional mustaches and facial hair patterns including but not limited to Mutton chops, Chevron, pyramid mustache, pencil mustache, and walrus.

In some embodiments, the right template may be contoured to substantially match a right region of the body, such as the right side of the face. The right template may include a right mount surface 224 that engages the body, and a right outer surface 206*a-d* that is visible while the right template is operational. The right mount surface and the right outer surface are shaped to form a desired hair pattern, such as a portion of a beard or moustache. The right template further comprises at least one right edge 204*a-d* that is tapered, so as to inhibit passage of a depilatory composition to the portion of the body covered by the right template.

The right mount surface may include an adhesive or shape that induces suction to help retain the right template on the right region of the body. Though in other embodiments, the right mount surface may not have any adhesion enhancers, and rely on a right handle portion to remain engaged to the right region of the body. The right template may further include a right outer surface that is visible while the right template is operational. The visible nature of the right outer surface enables at least one right alignment portion to display therefrom.

In some embodiment, the right template may further include a right handle portion 208*a-d* to enable holding the right template at a desired orientation on the body during removal of the hair. In yet another embodiment, the right outer surface of the right template comprises at least one right alignment portion 210 to help align the right template and indicate the intended region of the body to be covered by the right template.

In some embodiment, the left template may be contoured to substantially match a left region of the body, such as the left side of the face. The left template comprises a left mount surface 222 and a left outer surface 214*a-d*. Both surfaces are shaped to form a desired hair pattern, such as a portion of a beard or moustache. In one embodiment, the left template includes a left mount surface that engages the body, and a left outer surface that is visible while the left template is operational.

The left template may be contoured to substantially match a left region of the body, such as the left side of the face. The left mount surface and the left outer surface are shaped to form a desired hair pattern, such as a portion of a beard, a sideburn, or a portion of a moustache. The left template further comprises at least one left edge 216*a-d* that is tapered, so as to inhibit passage of a depilatory composition to the portion of the body covered by the left template.

The left mount surface may include an adhesive or shape that induces suction to help retain the left template on the left region of the body. Though in other embodiments, the left mount surface may not have any adhesion enhancers, and rely on a left handle portion to remain engaged to the left region of the body. The left template may further include a left outer surface that is visible while the left template is operational. The visible nature of the left outer surface enables at least one left alignment portion to display therefrom.

In some embodiment, the left template may further include a left handle portion 218*a-d* to enable holding the left template at a desired orientation on the body during removal of the hair. In yet another embodiment, the left outer surface of the left template comprises at least one left alignment portion 220 to help align the left template and indicate the intended region of the body to be covered by the left template. The left alignment portion may include a spaced apart markings and a "Left" or "Right" designation to help in proper orienting of the left template. Other markings could include, but are not limited to arrows, dots, letters, numbers, triangles, measurements such as on a tape measure.

Figure 3A:
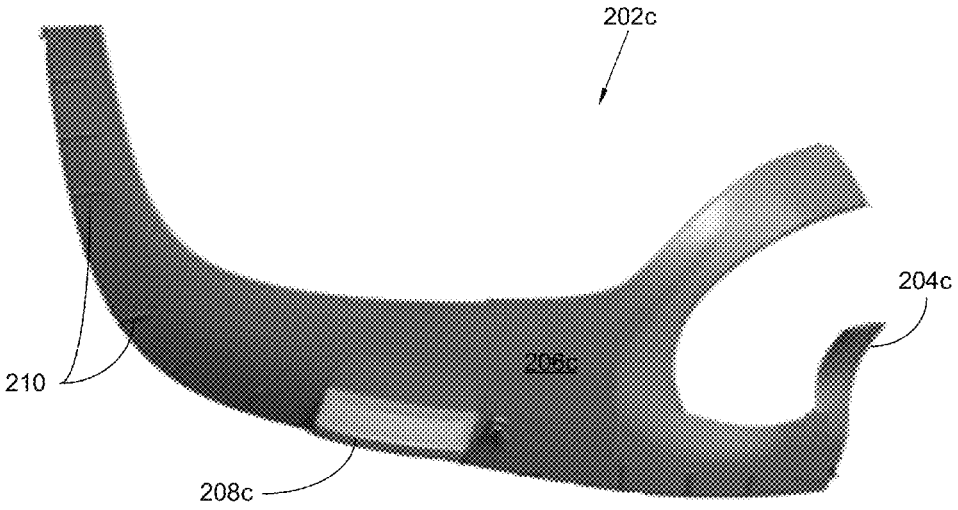
FIGS. 3A and 3B illustrate close up views of an exemplary right template, where
Figure 3B:
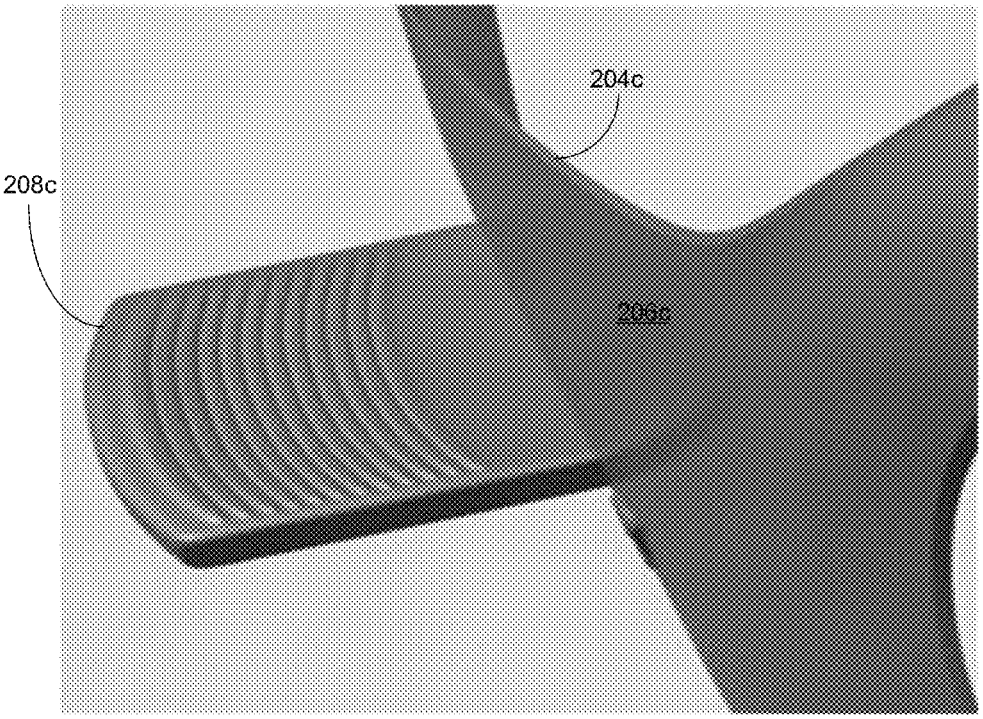

FIGS. 3A and 3B illustrate close up views of an exemplary right template, where FIG. 3A is a pattern for a two-piece full beard, and FIG. 3B is a close up view of an exemplary handle portion. In one aspect, the right edge of the right template is angled at about 45° to help contour the right region of the body more effectively. This unique contoured angle may also be used to enhance the middle edge and left edge of the respective templates. However, in other embodiments, additional angles less than and/or greater than 45° could be used.

In some embodiments, the right handle portion may be textured and ergonomically shaped to help grip and manipulate the right template. These same ergonomic features may also be utilized with the middle handle portion and left handle portion. Exemplary dimensions for a right template that is configured to pattern a two-piece full beard may include a length of 4.75", a height of 4", a width of ⅛". Though the dimensions may gradually change with the shape of the right template.

Figure 4:
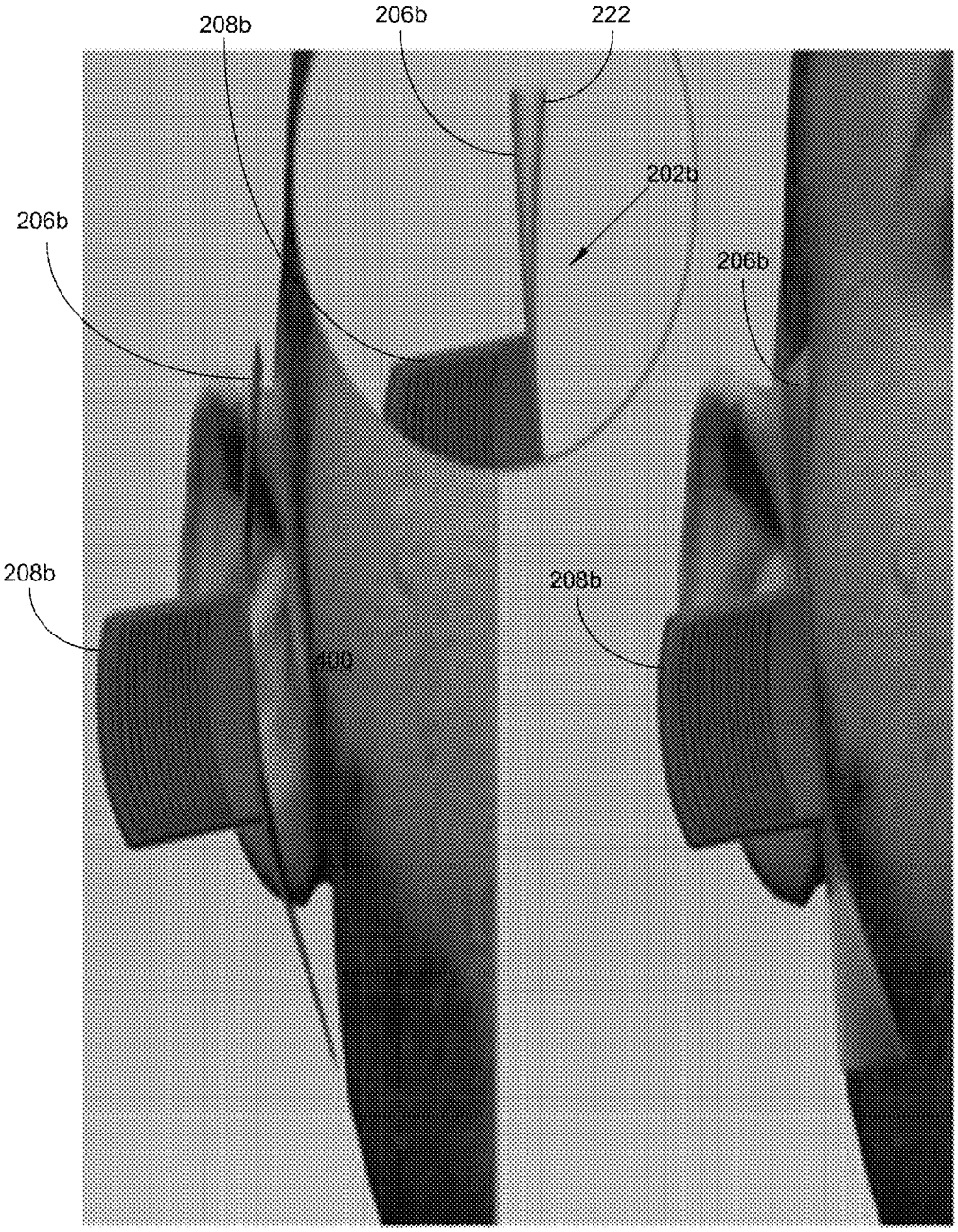
FIG. 4 illustrates a close up view of an exemplary right template covering a right region of the face, in accordance with an embodiment of the present invention.

FIG. 4 illustrates a close up view of an exemplary right template covering a right region of the face, in accordance with an embodiment of the present invention. In one aspect, the left and right handle portions of the templates may be helpful in holding the template to the face. This is illustrated in FIG. 4. The template portion is sufficiently flexible so as to conform to the shape of an individual's face and sideburn region. In one embodiment, the handle portion is about 0.885" long.

Figure 5:
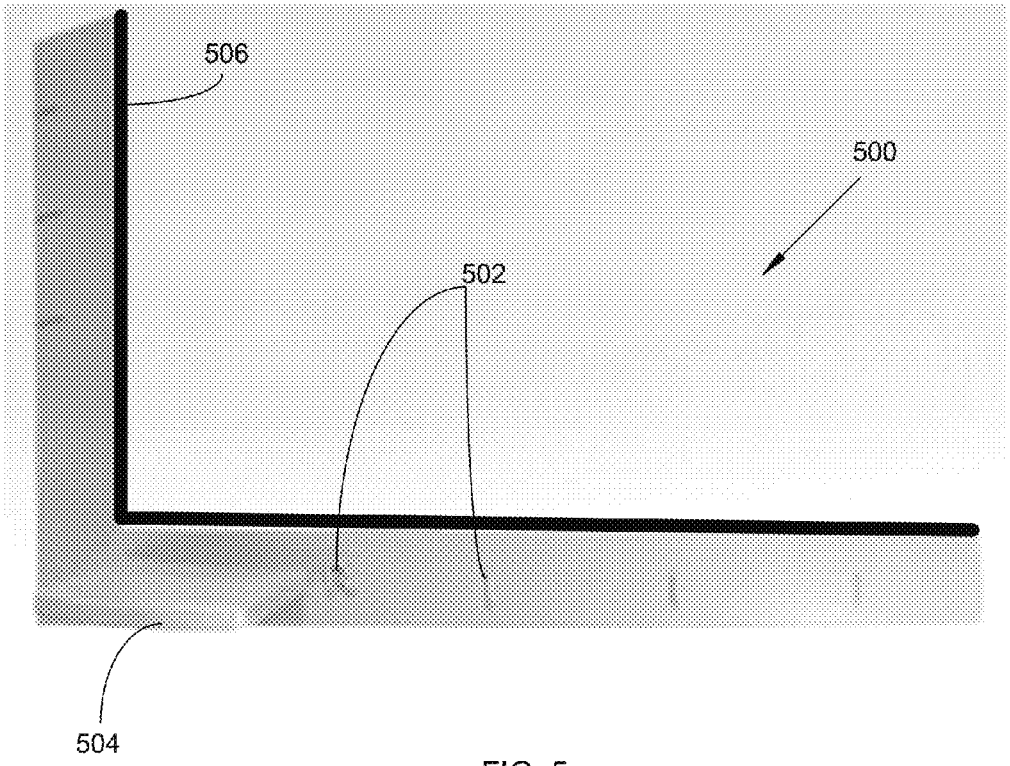
FIG. 5 illustrates a side view of an exemplary right template with a sideburn pattern with an exemplary jawbone strap, in accordance with an embodiment of the present invention.

FIG. 5 illustrates a side view of an exemplary right template with a sideburn pattern with an exemplary jawbone strap. In one aspect, a 90° angle sideburn pattern right template 500 is configured to form a sideburn having a generally right angle. A mirror image may also be possible with a sideburn pattern left template for the left side of the face. A right alignment portion 502 indicates the appropriate surface that should be facing away from the body, and provides measurement markings for precise formation of the right sideburn. A right handle portion 504 enables the precise manipulation as the depilatory composition is applied around the 90° angle sideburn pattern right template. In one embodiment, a rubber strip 506 form a continuous plane with the right edge to provide a smooth fit against the right region of the body, and to allow the user to pull down to tighten their skin while using the template.

Figure 6:
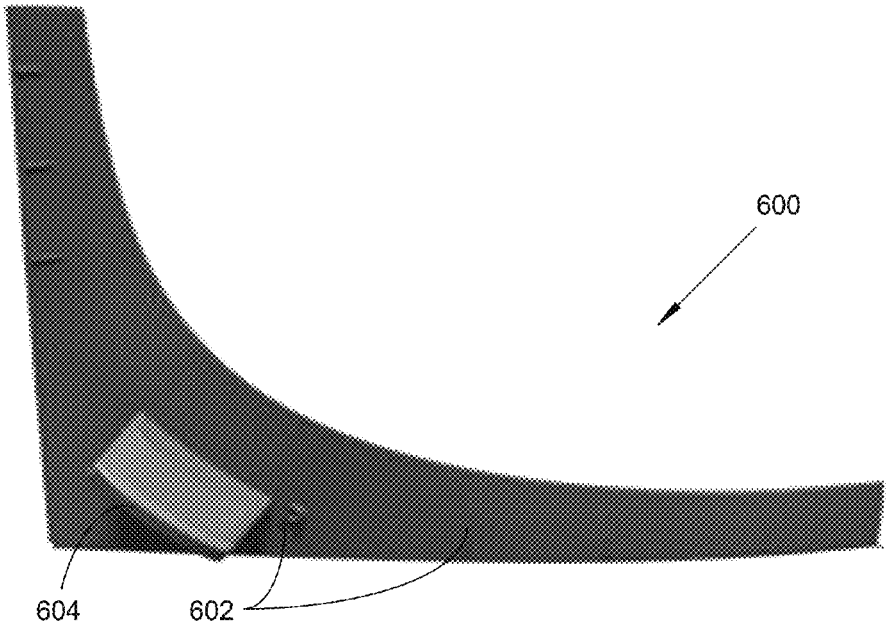
FIG. 6 illustrates a side view of an exemplary right template with a sideburn pattern with an exemplary curved jawbone strap, in accordance with an embodiment of the present invention.

FIG. 6 illustrates a side view of an exemplary right template with a sideburn pattern with an exemplary curved jawbone strap. In one aspect, a curved sideburn pattern right template 600 is configured to form a sideburn having a generally right angle. A mirror image may also be possible with a sideburn pattern left template for the left side of the face. A right alignment portion 602 indicates the appropriate surface that should be facing away from the body, and provides measurement markings for precise formation of the right sideburn. A right handle portion 604 enables the precise manipulation as the depilatory composition is applied around the curved sideburn pattern right template.

Figure 7A:
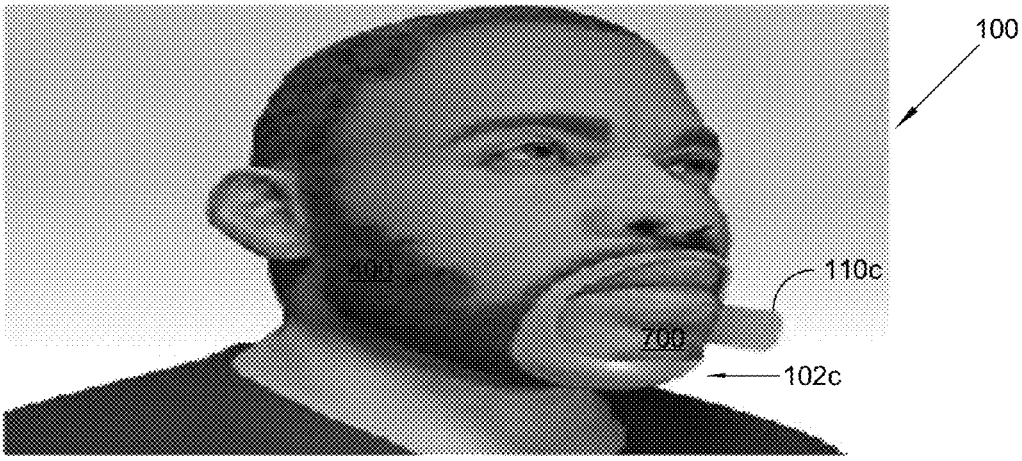
FIGS. 7A, 7B, and 7C illustrate perspective views of an exemplary middle template covering a middle region of the face, and an exemplary depilatory composition, where
Figure 7B:
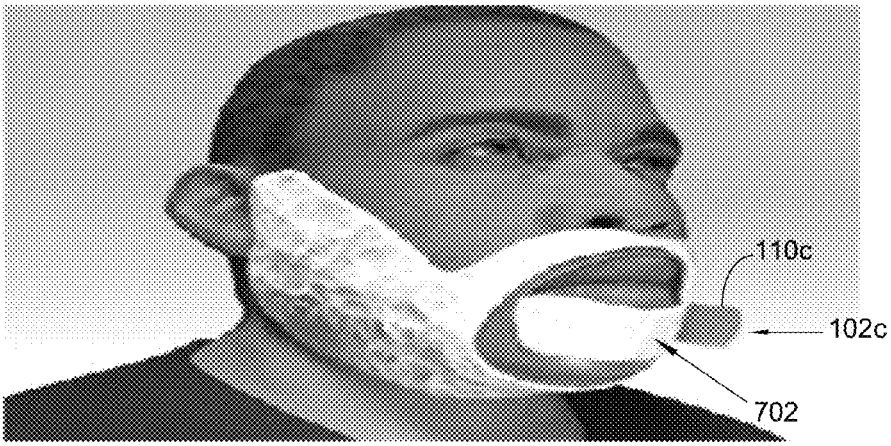
Figure 7C:
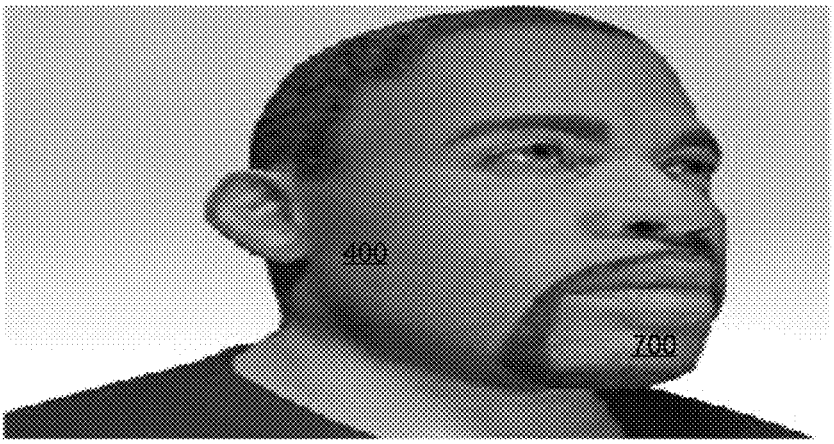

FIGS. 7A, 7B, and 7C illustrate perspective views of an exemplary middle template covering a middle region of the face, and an exemplary depilatory composition, where FIG. 7A is a middle template having a pattern for a goatee covering the middle region of the face, FIG. 7B is an exemplary depilatory composition applied around the middle template, and FIG. 7C is a hair pattern of a goatee after the middle template and the depilatory composition have been removed. In one aspect, a depilatory composition 702 is used with the pattern assembly to remove hair around the edges of the respective templates.

Those skilled in the art will recognize that depilatory compositions are often used to remove unwanted hair by chemical activity. Such compositions may comprise reducing agents to degrade keratin in the hair and thus weaken the hair strands. In some embodiments, the depilatory compositions may take the form of creams, lotions and the like which may be applied to the unwanted hair in a variety of ways, such as with a spatula.

In some embodiments, the depilatory composition used with the present pattern assembly may include a cosmetic preparation used to remove hair from the skin on the body. In some embodiments, the active ingredients for the depilatory composition may include, without limitation, calcium thioglycolate or potassium thioglycolate, which work to break down the disulfide bonds in keratin and weakens the hair so that it is easily scraped off where it emerges from the hair follicle.

FIG. 7A illustrates the at least one middle template overlaying a middle region 700 of the face. The middle template is configured to form a goatee hair pattern. FIG. 7B illustrates the depilatory composition applied around the edges of the middle template. Since the edges are contoured, the depilatory composition is restricted from seeping between the middle mount surface and the skin. FIG. 7C illustrates the depilatory composition with removed hair, and the middle template removed from the middle region of the body to reveal the goatee hair pattern that substantially matches the shape of the middle template.

In one alternative embodiment, the pattern assembly is used for forming hair patterns on the legs, genitalia region, neck, and scalp. In another alternative embodiment, the mount surfaces for the templates are coated with an adhesive. In another alternative embodiment, the templates are telescopically size adjustable along their lengths.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the data of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which data of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a template for controlling depilatory removal of hair according to the present invention will be apparent to those skilled in the art. Various aspects of the invention have been described above by way of illustration, and the specific embodiments disclosed are not intended to limit the invention to the particular forms disclosed. The particular implementation of the template for controlling depilatory removal of hair may vary depending upon the particular context or application. By way of example, and not limitation, the depilatory template for controlling the removal of hair to create a pattern through the use of a right template and a left template that join correlating left and right regions of a body, such that a depilatory composition applied on the skin and around the templates results in a hair pattern that substantially matches the templates; however, similar techniques may instead be applied to animal grooming, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An assembly, said assembly comprising:

at least one middle template, said at least one middle template comprising a middle mount surface and a middle outer surface, said middle mount surface being configured to enable at least partial engagement with a middle region of a body, said at least one middle template further comprising at least one middle edge, said at least one middle edge being substantially tapered, said tapered configuration of said at least one middle edge being configured to help inhibit passage into said middle region of said body that is engaged by said at least one middle template, said at least one middle template further comprising a middle handle portion, said middle handle portion being configured to enable gripping and manipulation of said middle template;

at least one right template, said at least one right template comprising a right mount surface and a right outer surface, said right mount surface being configured to enable at least partial engagement with a right region of said body, said at least one right template further comprising at least one right edge, said at least one right edge being substantially tapered, said tapered configuration of said at least one right edge being configured to help inhibit passage into said right region of said body that is engaged by said at least one right template, said at least one right template further comprising a right handle portion, said right handle portion being configured to enable gripping and manipulation of said right template;

at least one left template, said at least one left template comprising a left mount surface and a left outer surface, said left mount surface being configured to enable at least partial engagement with a left region of said body, said at least one left template further comprising at least one left edge, said at least one left edge being substantially tapered, said tapered configuration of said at least one left edge being configured to help inhibit passage into said left region of said body that is engaged by said at least one left template, said at least one left template further comprising a left handle portion, said left handle portion being configured to enable gripping and manipulation of said left template;

a rubber strip, said rubber strip disposed to form a continuous plane with said at least one right edge for forming a smooth fit against a right region of a body.

2. The assembly of claim 1, wherein said at least one middle template is configured to at least partially cover said middle region of said body consisting of under the chin and above the lips.

3. The assembly of claim 2, wherein said at least one middle template, said at least one right template, and said at least one left template are fabricated from material that includes at least one member selected from the group consisting of: polyvinyl chloride, plasticized polyvinyl chloride, low-density polyethylene, and paperboard with a wax or other coating.

4. The assembly of claim 1, wherein said at least one middle template is about ⅛ inches thick.

5. The assembly of claim 4, wherein said middle handle portion is a textured tab about one inch long.

6. The assembly of claim 5, wherein said at least one middle alignment portion comprises a left mark, a right mark, and a plurality of spaced-apart measurement lines to indicate a border.

7. The assembly of claim 6, wherein said at least one right template is configured to at least partially cover said right region of said body consisting of the right cheek, under the chin, and above the lips.

8. The assembly of claim 7, wherein said at least one right template is about ⅛ inches thick.

9. The assembly of claim 8, wherein said right handle portion is a textured tab about one inch long.

10. The assembly of claim 9, in which said right outer surface of said right template comprises at least one right alignment portion, said at least one right alignment portion being configured to help align said right template relative to said right region of said body.

11. The assembly of claim 10, wherein said at least one left template is configured to at least partially cover said left region of said body consisting of the left cheek, under the chin, and above the lips.

12. The assembly of claim 11, wherein said left handle portion is a textured tab about one inch long.

13. The assembly of claim 12, in which said left outer surface of said left template comprises at least one left alignment portion, said at least one left alignment portion being configured to help align said left template relative to said left region of said body.

14. An assembly, said assembly comprising:

means for at least partially covering a middle region of a body;

means for gripping and manipulating said middle region covering means;

means for at least partially covering a right region of a body;

means for gripping and manipulating said right region covering means;

means for at least partially covering a left region of a body;

means for gripping and manipulating said left region covering means;

means for chemically removing;

means for application of said chemical removal means around said middle region covering means, said right region covering means, and said left region covering means; and means for forming a continuous plane with at least one right edge for forming a smooth fit against a right region of a body.

15. An assembly, said assembly consisting of:

at least one middle template, said at least one middle template comprising a middle mount surface and a middle outer surface, said middle mount surface being configured to enable at least partial engagement with a middle region of a body, said at least one middle template further comprising at least one middle edge, said at least one middle edge being substantially tapered, said tapered configuration of said at least one middle edge being configured to help inhibit passage into said middle region of said body that is engaged by said at least one middle template, said at least one middle template further comprising a middle handle portion, said middle handle portion being configured to enable gripping and manipulation of said middle template, said at least one middle template further comprising at least one middle alignment portion, said at least one middle alignment portion being configured to help align said middle template relative to said middle region of said body;

at least one right template, said at least one right template comprising a right mount surface and a right outer surface, said right mount surface being configured to enable at least partial engagement with a right region of said body, said at least one right template further comprising at least one right edge, said at least one right edge being substantially tapered, said tapered configuration of said at least one right edge being configured to help inhibit passage into said right region of said body that is engaged by said at least one right template, said at least one right template further comprising a right handle portion, said right handle portion being configured to enable gripping and manipulation of said right template, said at least one right template further comprising at least one right alignment portion, said at least one right alignment portion being configured to help align said right template relative to said right region of said body;

at least one left template, said at least one left template comprising a left mount surface and a left outer surface, said left mount surface being configured to enable at least partial engagement with a left region of said body, said at least one left template further comprising at least one left edge, said at least one left edge being substantially tapered, said tapered configuration of said at least one left edge being configured to help inhibit passage into said left region of said body that is engaged by said at least one left template, said at least one left template further comprising a left handle portion, said left handle portion being configured to enable gripping and manipulation of said left template, said at least one left template further comprising at least one left alignment portion, said at least one left alignment portion being configured to help align said left template relative to said left region of said body; and a rubber strip, said rubber strip disposed to form a continuous plane with said at least one right edge for forming a smooth fit against a right region of a body.

* * * * *